United States Patent [19]

Chen et al.

[11] 4,159,567

[45] Jul. 3, 1979

[54] SHAVING INSTRUMENT

[75] Inventors: Evan N. Chen, Fairfield; Peter Bowman, Sandy Hook, both of Conn.

[73] Assignee: Warner-Lambert Company, Morris Plains, N.J.

[21] Appl. No.: 820,503

[22] Filed: Aug. 1, 1977

[51] Int. Cl.[2] ..... B26B 21/24
[52] U.S. Cl. ..... 30/62
[58] Field of Search ..... 30/62–65, 30/40–42

[56] References Cited

U.S. PATENT DOCUMENTS

| | | | |
|---|---|---|---|
| 3,140,541 | 7/1964 | Craig | 30/62 |
| 3,140,542 | 7/1964 | Craig | 30/62 |
| 3,178,814 | 4/1965 | Craig | 30/62 |
| 3,657,810 | 4/1972 | Nissen | 30/63 |
| 3,815,227 | 6/1974 | Hood | 30/64 |

*Primary Examiner*—Gary L. Smith
*Attorney, Agent, or Firm*—Jeremiah J. Duggan; Stephen A. Schneeberger

[57] ABSTRACT

An injector-type razor into which a blade may be mounted by means of a blade dispenser. The razor comprises the two-part assembly of a plastic molded main frame with handle and a spring-tensioned blade seat.

9 Claims, 4 Drawing Figures

SHAVING INSTRUMENT

BACKGROUND OF THE INVENTION

1. Field of the Invention

Shaving instruments with particular reference to improvements in injector-type razors.

2. Discussion of the Prior Art

Injector-type razors employ blades which are mounted in the razor main frame by means of a blade dispenser. A stem integral with the dispenser body is inserted into the razor to provide an opening between the razor blade seat and main frame into which a blade may be slid from the dispenser to the razor blade seat.

These razors customarily comprise, in addition to the main frame and blade seat, a flat spring and handle each requiring separate and different manufacturing operations to produce and less than optimum ease and simplicity to assemble.

With multiple manufacturing operations reflecting high parts cost and the assembly operation attended by tediousness due to the multiplicity of parts, i.e. a minimum of four, the art is currently in need of injector razor improvement wherewith the usual relatively high manufacturing and consumer cost can be reduced.

It is with the objective of reducing product cost and further with a view to affording functional as well as structural improvement in injector razors that the present invention has provided a simple, inexpensive and highly durable shaving instrument which overcomes the aforementioned and related drawbacks of prior art devices. Another object of the invention is to eliminate the cost of blank (unsharpened) blades in injector razors which have heretofore been used in new razors for facilitating the first injection of a shaving blade.

Other objects and advantages will become apparent from the following description of the invention.

SUMMARY OF THE INVENTION

The aforesaid objects of the invention and their corollaries are accomplished by constructing an injector-type razor of two parts, namely a molded main frame including handle and a blade seat.

The blade seat is formed of material which provides the spring action required to clamp a shaving blade to the main frame. It is further provided with pivot lugs affording a fixed position in the main frame relative to which the blade seat may be selectively pivotally sprung to receive a shaving blade and thereafter released to clamp the blade in place. Barbs provided on a tail section of the blade seat enable permanent locking together of the two razor parts with a simple pressing operation.

Additionally, the aforesaid pivoting action is such that when operated by insertion of a conventional blade dispenser stem, a clear space will be provided between the main frame and blade seat for freely receiving a shaving blade thereby eliminating need for the blank (unsharpened blade) usually found in a new razor.

Details of the invention will become apparent from the following description when taken in conjunction with the accompanying drawings.

IN THE DRAWINGS

DESCRIPTION OF THE PREFERRED EMBODIMENTS

Figure 1:
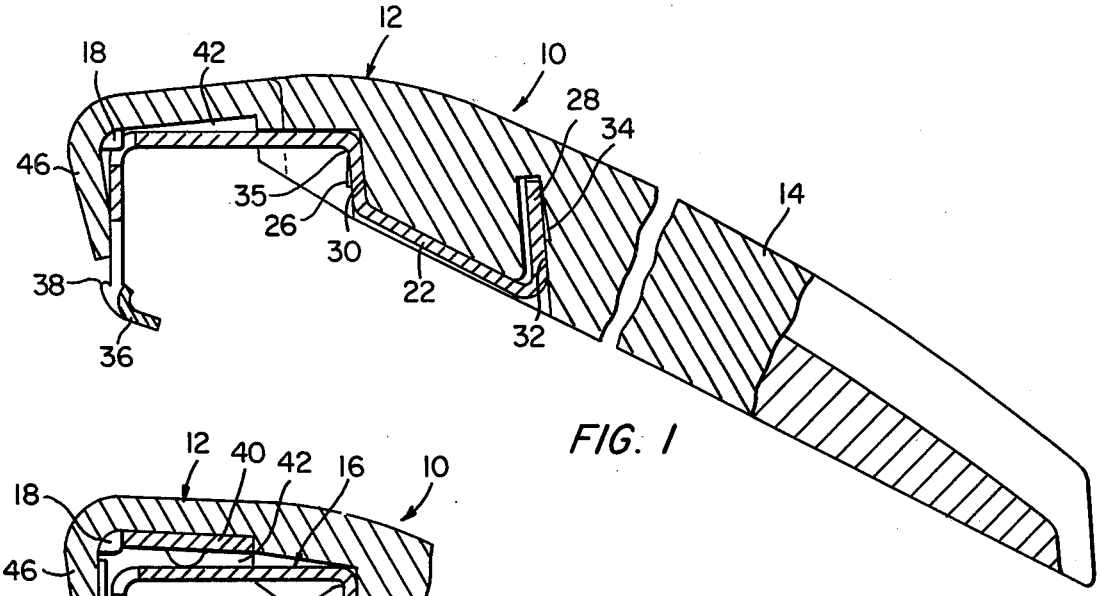
FIG. 1 is an illustration, partially in cross-section, of a preferred embodiment of the invention.
Figure 4:
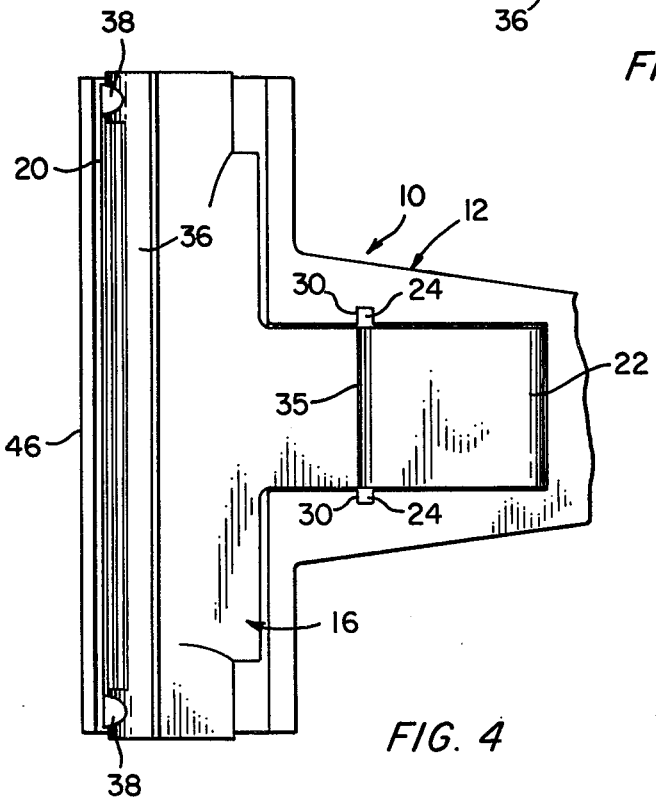
FIG. 4 is a bottom plan view of the loaded razor.

Referring to the drawings and in particular to FIGS. 1 and 4, it can be seen that injector razor 10 is comprised of an assembly of two parts, namely main frame 12 having extension 14 which provides a handle and blade seat 16.

Main frame 12 is preferably formed of a molded plastic having its underside recessed to receive blade seat 16 and provided with integral blade locating stops 18. As it will become more apparent hereinafter, stops 18 are ultimately engaged by the uppermost blunt edge of an injector razor blade introduced into the razor system for purposes of locating the blade in proper position and orientation for shaving when fully clamped thereagainst by blade seat 16.

Figure 2:
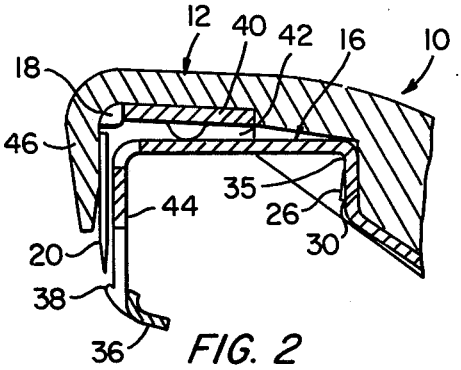
FIG. 2 is a fragmentary cross-sectional view of the injector razor of FIG. 1 wherein the operation of loading the razor with a shaving blade is illustrated.
Figure 3:
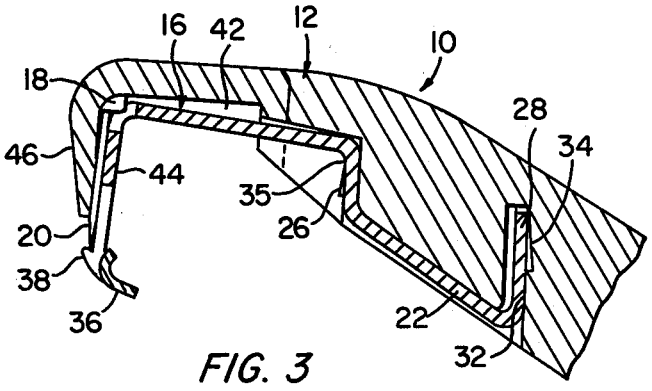
FIG. 3 is a fragmentary cross-sectional view of the razor after loading.

Blade seat 16 is formed from spring-tempered flat stock, e.g. sheet steel, to the illustrated shape which provides the spring action required to clamp a shaving blade 20 (injector type) to main frame 12. Blade seat 16 is provided with a generally U-shaped tail section 22 having a pair of laterally extending lugs 24 (FIG. 4) which are provided with barbs 26 (FIGS. 1–3). Lugs 24 and the free end 28 of tail section 22 are respectively pressed into receiving slots 30 and 32 which are provided in the recessed under portion of main frame 12. Barbs 26 and additional barbs 34 on end 28 permanently lock blade seat 26 in place.

Lugs 24 and slots 30 (FIGS. 1 and 4) establish pivot line 35 relative to which the remaining forward portion of blade seat 16 is permitted to pivot under spring tension for purposes of receiving and clamping a blade 20 in place.

The barbed U-shaped tail section 22, together with receiving slots 30 and 32 enable the use of a simple pressing operation to provide a permanent assembly of the two-piece unit of blade seat and main frame.

It should be understood that while it may be preferable to form blade seat 16 of a corrosion-resistant, spring-tempered metal, a high strength resilient plastic may be substituted to meet particular requirements.

The forward terminus of blade seat 16 is provided with guard bar 36 and forwardly disposed blade clips 38, one adjacent each of opposite ends of guard bar 36.

Introduction of a shaving blade 20 into razor 10 is accomplished by inserting the stem 40 of a conventional blade dispenser into space 42 as illustrated in FIG. 2. This action forces the forwardly disposed free end of blade seat 16 downwardly against spring tension therein tending to resist such movement. In so doing, the forward blade rest portion 44 of blade seat 16 is moved away from nose 46 of main frame 12 providing free space for the insertion of blade 20 therebetween (FIG. 2).

After so positioning blade 20 (e.g. by manipulation of the usual grip which is provided on the blade dispenser body, not shown) the dispenser stem 40 is retracted thereby permitting blade seat 16 to return toward its initial more relaxed FIG. 1 position. This causes clips 38 to engage the sharp edge of blade 20 forcing the blade upwardly against stops 18 and clamping it between rest 44 and nose 46 of main frame 12 as illustrated in FIG. 3. Razor 10 is thus rendered ready for use and replacement of blade 20 when spent can be accomplished by repeating the above-described use of the blade dispenser. Insertion of a second blade will eject the spent blade and so on.

Referring more particularly to FIGS. 1 and 2, it can be seen that razor 10 can be marketed without the need for a blank (unsharpened) blade which is usually provided in injector-type razors for the purpose of facilitating injection of the first shaving blade. In the present structure, space 42 (FIG. 1) is fully adequate for insertion of an injector blade dispenser's stem 40 without a blank blade prepositioned between blade rest 44 and nose 46. Furthermore, following insertion of stem 40 (FIG. 2), pivoting of blade seat 16 about line 35 provides a uniform spacing between rest 44 and nose 46 which is adapted to freely receive the first and successive shaving blades 20. The elimination of blank blades according to this invention represents a substantial savings in preparing razors 10 for the market.

We claim:

1. An injector razor comprising:

a molded main frame having a handle;

an integral resilient blade seat having a tail section secured to said main frame and a pivotable blade rest portion for selectively receiving and clamping a shaving blade against said main frame, said main frame being recessed and said tail section including a pair of laterally oppositely extending lugs adjacent said pivotable blade rest portion, said lugs being set into slots provided in said recessed under portion of said main frame and establishing along a line extending therebetween, a position about which said blade rest portion of said blade seat may be pivoted for receiving and clamping said blade against said main frame.

2. A razor according to claim 1 wherein said main frame is recessed and slotted to receive said blade seat and said tail section of said blade seat is provided with barbs pressed into said slotted portion of said main frame for securing said blade seat in place.

3. A razor according to claim 1 wherein said main frame includes a depending nose portion against which said shaving blade is held by said blade rest portion of said blade seat when said shaving blade is received and clamped in said razor.

4. A razor according to claim 3 wherein said nose portion of said main frame includes a pair of proximally disposed stops against which an unsharpened edge of said shaving blade may be located and clamped by said blade seat and said blade rest portion of said seat terminates with a guard bar and adjacent blade edge clips, the latter engaging an opposite sharpened edge of said blade and holding said blade in place firmly against said stops, said blade seat being under tension against said blade.

5. A razor according to claim 4 wherein said main frame is recessed below said blade seat for receiving the stem of an injector blade dispenser to urge said blade rest portion of said blade seat away from said nose portion of said main frame when dispensing of shaving blades into said razor and ejecting same is desired.

6. A razor according to claim 1 wherein said main frame is formed of a molded plastic material and said blade seat is formed of metal, at least a portion of said blade seat being spring-tempered.

7. A razor according to claim 1 wherein said main frame is formed of a molded plastic material and said blade seat is formed of a high strength resilient plastic material.

8. A razor according to claim 7 wherein said main frame is formed of a molded plastic material and said blade seat is formed of metal, at least a portion of said blade seat being spring-tempered.

9. A razor according to claim 5 wherein said main frame is formed of a molded plastic material and said blade seat is formed of a high strength resilient plastic material.

* * * * *